US009908545B2

(12) United States Patent
Peltz

(10) Patent No.: US 9,908,545 B2
(45) Date of Patent: Mar. 6, 2018

(54) METHOD AND SYSTEM FOR OPERATING A VEHICLE SYSTEM TO REDUCE WHEEL AND TRACK WEAR

(71) Applicant: GENERAL ELECTRIC COMPANY, Schenectady, NY (US)

(72) Inventor: David Michael Peltz, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 218 days.

(21) Appl. No.: 14/854,736

(22) Filed: Sep. 15, 2015

(65) Prior Publication Data

US 2016/0082993 A1 Mar. 24, 2016

Related U.S. Application Data

(60) Provisional application No. 62/053,552, filed on Sep. 22, 2014.

(51) Int. Cl.

| | |
|---|---|
| ***B61K 9/00*** | (2006.01) |
| ***B61K 9/04*** | (2006.01) |
| ***B61K 9/12*** | (2006.01) |
| ***B61L 27/00*** | (2006.01) |
| ***B61L 3/00*** | (2006.01) |

(Continued)

(52) U.S. Cl.

CPC ..... *B61L 27/0083* (2013.01); *B61L 3/006* (2013.01); *B61L 15/0081* (2013.01); *B61L 25/021* (2013.01); *B61L 25/025* (2013.01); *B61L 27/0027* (2013.01); *B61L 2205/04* (2013.01)

(58) Field of Classification Search

None

See application file for complete search history.

(56) References Cited

U.S. PATENT DOCUMENTS 1,802,436 A * 4/1931 Maas ..... B60B 17/0055 104/307

3,718,040 A * 2/1973 Freeman ..... G01L 5/161 73/146

(Continued)

FOREIGN PATENT DOCUMENTS

KR 20090085221 A 8/2009

WO 2006021050 A1 3/2006

OTHER PUBLICATIONS

European Search Report issued in connection with corresponding EP Application No. 15186153.1 dated Feb. 5, 2016.

*Primary Examiner* — Navid Ziaeianmehdizadeh

(74) *Attorney, Agent, or Firm* — GE Global Patent Operation; John A. Kramer

(57) ABSTRACT

A method includes determining a location of a vehicle system traveling on a track during a first trip relative to a curve in the track. The method also includes monitoring a temperature profile at a contact interface between a wheel of the vehicle system and a rail of the track that contacts the wheel as the vehicle system traverses the curve in the track. The temperature profile is based, at least in part, on a first speed profile of the vehicle system during the first trip. The method further includes analyzing the temperature profile to detect a flanging event between the wheel and the rail as the vehicle system traverses along the curve in response to the temperature profile indicating that a flange of the wheel engages a side of the rail.

20 Claims, 4 Drawing Sheets

(51) Int. Cl.
*B61L 15/00* (2006.01)
*B61L 25/02* (2006.01)

(56) References Cited

U.S. PATENT DOCUMENTS 3,731,087 A * 5/1973 King ..... B61K 9/04 246/169 D
3,864,039 A * 2/1975 Wilmarth ..... B61K 9/08 33/287
4,230,043 A * 10/1980 Aldington ..... B60B 17/0055 104/306
4,711,320 A * 12/1987 Dombroski ..... B61K 3/00 184/3.2
4,895,408 A * 1/1990 Wiebe ..... B61K 3/00 184/3.1
4,930,600 A * 6/1990 Kumar ..... F16N 29/02 104/279
4,936,529 A * 6/1990 Maine ..... B61K 9/12 246/169 R
5,368,260 A * 11/1994 Izbinsky ..... B61K 9/12 246/169 R
5,577,690 A * 11/1996 Haddox ..... B61K 9/12 246/169 R
5,636,026 A * 6/1997 Mian ..... B61K 9/12 250/224
5,677,533 A * 10/1997 Yaktine ..... B61K 9/04 246/169 A
6,182,793 B1 * 2/2001 Jamison ..... B61K 3/02 184/3.2
6,585,085 B1 * 7/2003 Kumar ..... B61K 3/00 184/3.2
6,695,472 B1 * 2/2004 Nayer ..... B61K 9/06 250/338.1
6,813,581 B1 * 11/2004 Snyder ..... G01K 7/42 246/169 A
6,872,945 B2 * 3/2005 Bartonek ..... G01J 5/0022 246/169 A
7,278,305 B2 * 10/2007 Kilian ..... B61L 1/04 73/146
7,926,362 B2 * 4/2011 Andersson ..... G01L 5/161 73/862.041
8,087,362 B2 * 1/2012 Lee ..... B60B 17/0006 104/242
8,280,675 B2 * 10/2012 Church ..... B61K 9/04 702/130
8,335,606 B2 * 12/2012 Mian ..... G01M 17/013 250/330
8,439,315 B2 * 5/2013 Kilian ..... B61K 9/06 246/167 R
8,925,873 B2 * 1/2015 Gamache ..... B61K 9/12 246/169 R
9,365,223 B2 * 6/2016 Martin ..... B61L 15/0027
9,476,802 B2 * 10/2016 Sato ..... G01L 5/18
2003/0006655 A1 * 1/2003 Zhang ..... B61K 9/04 310/52
2003/0111295 A1 * 6/2003 Kumar ..... B61K 3/00 184/3.1
2004/0075570 A1 * 4/2004 Bartonek ..... B61K 9/04 340/682
2004/0190591 A1 * 9/2004 Zhang ..... G01K 3/005 374/162
2006/0010971 A1 * 1/2006 Kilian ..... B61L 1/04 73/146
2006/0131464 A1 * 6/2006 Hesser ..... B61K 9/06 246/169 D
2006/0163004 A1 * 7/2006 Kumar ..... B61K 3/00 184/3.1
2006/0180760 A1 * 8/2006 Lane ..... G01J 5/0022 250/339.05
2007/0023538 A1 * 2/2007 Aleynik ..... E01B 5/02 238/122
2007/0090201 A1 * 4/2007 Jones ..... E01B 19/00 238/122
2009/0040503 A1 * 2/2009 Kilian ..... B61L 27/0094 356/23
2009/0049936 A1 * 2/2009 Mian ..... G01M 17/10 73/865.8
2010/0023190 A1 * 1/2010 Kumar ..... B61L 3/006 701/20
2011/0101717 A1 * 5/2011 Zdrojewski ..... B60B 17/0068 295/1
2012/0046900 A1 * 2/2012 Baert ..... B61F 5/24 702/141
2012/0136515 A1 5/2012 Noffsinger et al.
2012/0277940 A1 * 11/2012 Kumar ..... B61L 27/0027 701/20
2014/0142791 A1 * 5/2014 Boehni ..... B61K 3/00 701/19
2014/0169398 A1 * 6/2014 Arndt ..... G01K 15/007 374/1
2016/0101792 A1 * 4/2016 Bartonek ..... B61K 9/06 701/20
2016/0103083 A1 * 4/2016 Bartonek ..... B61K 9/04 701/19
2016/0177513 A1 * 6/2016 Ohata ..... E01B 5/14 238/148
2016/0272228 A1 * 9/2016 LeFebvre ..... B61L 15/0027

* cited by examiner

METHOD AND SYSTEM FOR OPERATING A VEHICLE SYSTEM TO REDUCE WHEEL AND TRACK WEAR

CROSS-REFERENCE TO RELATED APPLICATIONS

This application claims priority to U.S. Provisional Application No. 62/053,552, filed 22 Sep. 2014, which is incorporated by reference in its entirety.

FIELD

Embodiments of the subject matter described herein relate to a method and system for operating rail vehicles traveling along routes to reduce wheel and track wear around curves in the routes.

BACKGROUND

Some rail vehicle systems are used for transporting various freight, including, for example, coal, lumber, and manufactured goods, along a route from an origination location to a destination location. The rail vehicle systems may be long with a large number of cars in order to increase the amount of freight moved during each trip. For example, a coal train carrying coal from coal mines to electrical power plants may include at least one hundred coupled coal cars and multiple propulsion-generating locomotives, spanning a length that exceeds a mile. The cars experience longitudinal forces due to the push and/or pull of the locomotives on the cars. The longitudinal forces around curves may cause lateral movement of the cars relative to the tracks. For example, compressive forces on a car may cause the car to jack-knife along a curve, forcing the wheels of the car to move laterally outward relative to the rails (e.g., radially outward relative to the curve). In addition, tension on a car may cause the car to string-line along the curve, which pulls the wheels of the car laterally inward relative to the rails (e.g., radially inward relative to the curve). With sufficient force, the wheels may be shifted to an extent that flanging occurs, which is when a flange of a wheel contacts a side of the rail. During flanging, the wheel simultaneously engages both a top and the side of the rail which causes metal-to-metal grinding and produces high wheel and rail wear. The friction created by the metal-to-metal grinding also provides resistance which slows the rail vehicle system. High wheel and rail wear results in a high frequency of vehicle and track maintenance, such as replacing worn wheels and sections of rails. In addition, flanging increases fuel costs as the locomotives have to increase tractive efforts to compensate for the increased friction and grinding between the wheel and the rail in order to maintain a desired speed.

It is generally known that more aggressive train operations (for example, faster speeds) around curves increase wear rates and fuel use, so less aggressive train operations around curves may be desirable from a maintenance and fuel cost perspective. However, railroads typically have performance incentives for increasing the speed of a vehicle system along the route, such as to arrive at the destination by a set time, maintain a high throughput along the route (so as not to slow other rail vehicle systems traveling along the route), and the like, and these performance incentives have quantifiable monetary values (for example, receive a bonus for arriving at the destination by a given time). On the other hand, a direct and quantifiable correlation between train operations along curves and the resulting wheel and rail wear is not generally known, so the railroads do not factor in maintenance costs when determining how to operate the rail vehicles in order to increase monetary profit. A need remains for a system and method for reducing wheel and rail wear along curves in a route.

BRIEF DESCRIPTION

In an embodiment, a method is provided that includes determining a location of a vehicle system traveling on a track during a first trip relative to a curve in the track. The method also includes monitoring a temperature profile at a contact interface between a wheel of the vehicle system and a rail of the track that contacts the wheel as the vehicle system traverses the curve in the track. The temperature profile is based, at least in part, on a first speed profile of the vehicle system during the first trip. The method further includes analyzing the temperature profile to detect a flanging event between the wheel and the rail as the vehicle system traverses along the curve in response to the temperature profile indicating that a flange of the wheel engages a side of the rail.

In an embodiment, a system is provided that includes a locator device, a temperature sensor, and one or more processors. The locator device is configured to determine a location of a vehicle system traveling on a track during a first trip. The temperature sensor is configured to monitor a temperature profile at a contact interface between a wheel of the vehicle system and a rail of the track that contacts the wheel as the vehicle system traverses the track. The one or more processors are configured to identify when the vehicle traverses a curve in the track based on the location of the vehicle system. The temperature profile at the contact interface as the vehicle system traverses the curve is based, at least in part, on a first speed of the vehicle system along the curve. The one or more processors are further configured to analyze the temperature profile to detect a flanging event between the wheel and the rail as the vehicle system traverses along the curve in response to a characteristic of the contact interface exceeding a threshold.

In another embodiment, a method is provided that includes monitoring a temperature profile of at least one of a wheel of a vehicle system or a rail of a track that contacts the wheel. The vehicle system is configured to travel along a segment of the track on a trip. The method also includes determining a location of the vehicle system on the segment of the track relative to predefined locations of curves in the track. The method further includes determining an amount of wear of the at least one of the wheel or the rail by analyzing effects on the temperature profile by the vehicle system traveling along the curves in the track.

In yet another embodiment, a system is provided that includes a temperature sensor configured to be disposed on a vehicle system as the vehicle system travels along a segment of track on a trip. The temperature sensor is configured to monitor a temperature profile of at least one of a wheel of the vehicle or a rail of the track that contacts the wheel. The system also includes a locator device configured to determine a location of the vehicle system on the segment of track relative to predefined locations of curves in the track. The system further includes a processor configured to analyze effects on the temperature profile by the vehicle system traveling along the curves in the track to determine an amount of wear of at least one of the wheel or the rail.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
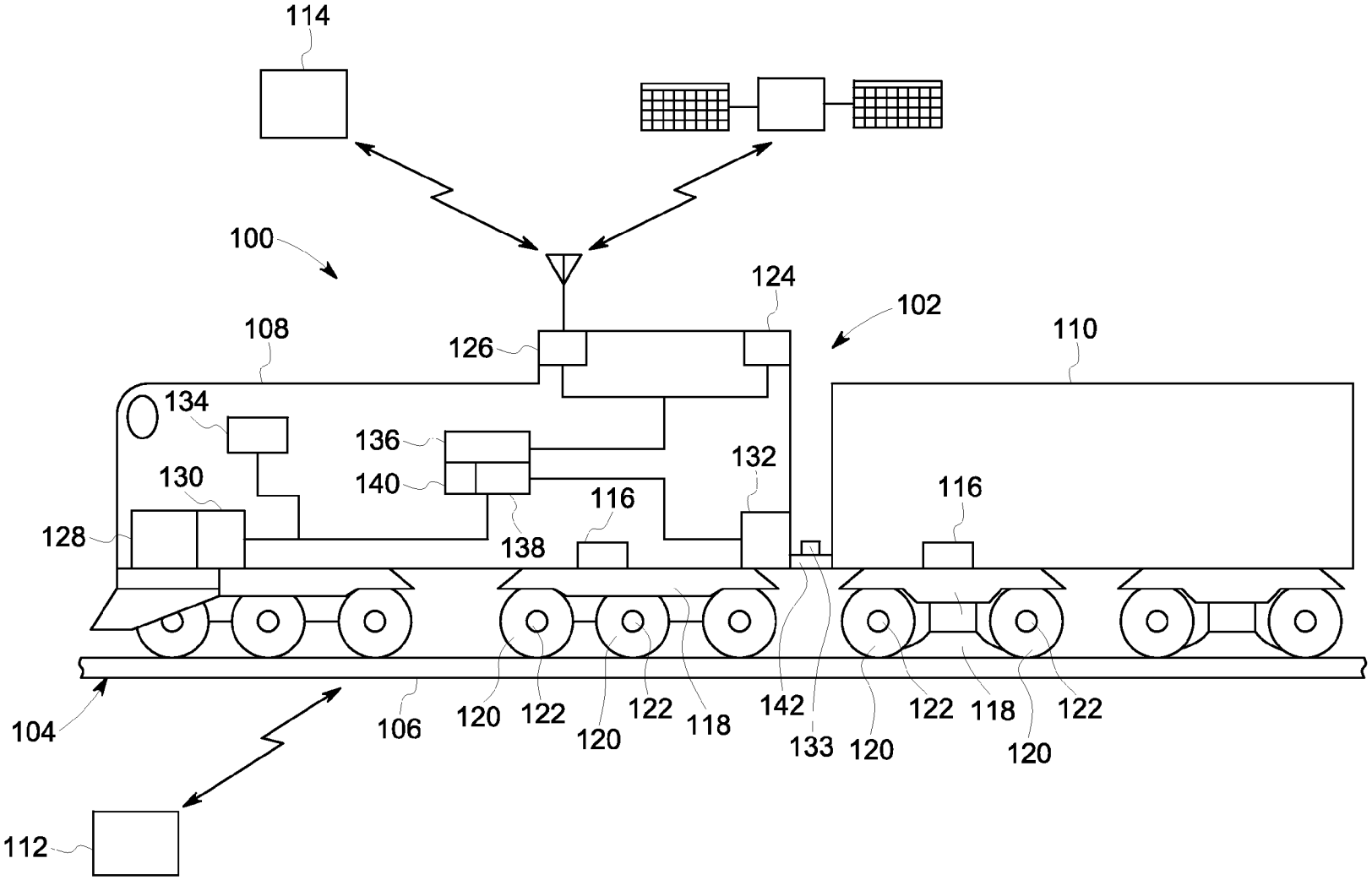
FIG. 1 is a schematic diagram of a trip planning system in accordance with an embodiment.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the inventive subject matter are not intended to be interpreted as excluding the existence of additional embodiments that also incorporate the recited features. Moreover, unless explicitly stated to the contrary, embodiments "including," "comprising," or "having" (and various forms thereof) an element or a plurality of elements having a particular property may include additional such elements not having that property.

As used herein, the terms "module", "system," "device," or "unit," may include a hardware and/or software system and circuitry that operates to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

One or more embodiments disclosed herein describe a method and system used in conjunction with a vehicle system traveling along a route. The method and system may be used for determining an operating strategy for controlling a vehicle system to improve certain objective performance criteria while satisfying schedule and speed constraints. In one embodiment, the system analyzes temperature profiles of the wheels of a rail vehicle system on the rails, track characterization information, vehicle characterization information, and operating information to determine a quantifiable correlation between operations of a vehicle system around curves in a route and the resulting wheel and track wear. In another embodiment, the system monitors and controls vehicle system operations, such as speed, acceleration, and deceleration, along curves and track switches, to reduce lateral forces along curves and track switches. Reducing lateral forces along curved sections of the route decreases occurrences of jack-knifing and string-lining, and therefore reduces wheel and track wear, fuel usage, and/or emissions. The system controls the vehicle system operation based on a determined correlation between vehicle system operations and wheel and track wear. The wheel and track wear and fuel usage can also be correlated with maintenance and operating costs such that selecting a speed profile to traverse specific curved track sections offers trade-offs among speed of completing the trip, fuel used, emissions produced, and wear of the track and wheel infrastructure components. The trade-offs may be weighted or prioritized to increase monetary profit, which is measured as the difference between performance gains (or income) and maintenance and operating costs (or expenses).

At least one technical effect of the various embodiments may include increased availability of wheel and rail wear information that is used for controlling a rail vehicle system on a trip along a route. For example, the various embodiments may detect conditions that cause flanging between the wheel and the rail, which increases wheel and rail wear, and such information about the condition may be used to avoid flanging during subsequent trips in order to reduce wheel and rail wear. Another technical effect may include determining and implementing an operating strategy for controlling a rail vehicle system to improve certain performance parameters or mission parameters, such as reducing wheel and rail wear, while satisfying schedule and speed constraints. A further technical effect of one or more embodiments herein may include determining and implementing an operating strategy for controlling a rail vehicle system that factors the monetary cost of vehicle and track maintenance, the monetary cost of fuel usage, and the monetary gain of meeting or exceeding performance-based goals (such as arrival times) that increases overall monetary profit of the trip of the rail vehicle along the route.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, one or more of the functional blocks (for example, processors, controllers, or memories) may be implemented in a single piece of hardware (for example, a general purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

FIG. 1 illustrates a schematic diagram of a trip planning system 100 according to an embodiment. The trip planning system 100 is disposed on a vehicle system 102. The vehicle system 102 is a rail vehicle system that travels on a track 104. The track 104 includes multiple electrically-conductive rails 106. The track 104 extends along a route. The vehicle system 102 is configured to travel along the route on various trips from a starting location to a destination or arrival location. The vehicle system 102 includes at least one propulsion-generating vehicle 108 and at least one non-propulsion-generating vehicle 110. The propulsion-generating vehicle 108 is configured to generate tractive efforts to propel (for example, pull or push) the at least one non-propulsion generating vehicle 110 along the track 104. The propulsion-generating vehicle 108 may be referred to herein as a locomotive 108, and the non-propulsion generating vehicle 110 may be referred to herein as a rail car or car 110. In the illustrated embodiment, the trip planning system 100 is disposed on the locomotive 108. In other embodiments, however, one or more components of the trip planning system 100 may be located on one or more cars 110 of the vehicle system 102, one or more different locomotives 108 of the vehicle system 102, a wayside device 112, a remote off-board location 114 (for example, a dispatch location), or the like.

One locomotive 108 and one car 110 are shown in FIG. 1, although the vehicle system 102 may include multiple locomotives 108 and/or multiple cars 110. For example, the vehicle system 102 optionally may be a distributed power vehicle system, which has plural locomotives 108 or locomotive consists and includes a lead locomotive that controls one or more remote locomotives. It is understood that the reference to a lead locomotive refers to a logical lead locomotive, which is the locomotive that controls operation of the other locomotives. The lead locomotive may be in any physical location along the length of the vehicle system 102.

As the vehicle system 102 travels along a trip on the track 104, the trip planning system 100 may be configured to measure, record, or otherwise collect input information about the track 104, the vehicle system 102, and the movement of the vehicle system 102 on the track 104. For example, the trip planning system 100 may be configured to measure a temperature of the rails 106 as the vehicle system 102 travels along the track 104 on a trip. In addition, the trip planning system 100 may be configured to analyze the collected input information and control the movement of the vehicle system or another vehicle system based on the input information. For example, the trip planning system 100 may generate a trip plan based on the input information that provides operating parameters or orders for the vehicle system 102 to follow during the trip and/or during a subsequent trip along the route. The parameters include tractive and braking efforts expressed as a function of location of the vehicle system 102 along the route, distance along the route, and/or time. Alternatively, the trip planning system 100 does not generate the trip plan, but rather receives and/or selects a previously-generated trip plan from the remote off-board location 114 or a memory on the vehicle system 102. The trip plan is configured to realistically maximize (e.g., increase or enhance) desired parameters, such as energy efficiency and speed, and realistically minimize (e.g., decrease or reduce) desired parameters, such as wheel and rail wear, fuel usage, and emissions, while meeting constraints such as speed limits, schedules, and the like. For example, the trip plan may reduce energy consumption during the trip, relative to controlling the vehicle system not according to the trip plan, while abiding by safety and regulatory restrictions. The trip plan may be established using an algorithm based on models for vehicle behavior for a vehicle system along a route.

The trip planning system 100 may be configured to control the vehicle system 102 along the trip based on the trip plan. For example, the trip planning system 100 may automatically control or implement a throttle and brake of the vehicle system 102 consistent with the trip plan or may suggest control settings for the throttle and brake of the vehicle system 102 to an operator of the vehicle system 102 (for manual implementation by the operator). The trip planning system 100 may be or include a Trip Optimizer™ system of General Electric Company, or another energy management system. For additional discussion regarding a trip profile, see U.S. patent application Ser. No. 12/955,710, Publication No. 2012/0136515, "Communication System for a Rail Vehicle Consist and Method for Communicating with a Rail Vehicle Consist," filed 29 Nov. 2010, the entire contents of which are incorporated herein by reference.

The trip planning system 100 includes temperature sensors 116 disposed on or near trucks or bogies 118 of the vehicle system 102. The trucks 118 include multiple wheels 120 and at least one axle 122 that couples left and right wheels 120 together (only the left wheels of the trucks 118 are shown in FIG. 1). Optionally, the trucks 118 may be fixed-axle trucks, such that the wheels 120 are rotationally fixed to the axles 122. The temperature sensors 116 may be thermocouples, thermistors, thermal imagers (that measure infrared energy), resistance temperature sensors, or the like. The temperature sensors 116 are configured to measure or monitor a temperature of the wheels 120 and/or a temperature of the rails 106 at a contact interface where the wheels 120 contact the rails 106. The temperature sensors 116 may be located on a left side of the vehicle system 102 and on a right side of the vehicle system 102 to monitor the temperatures of the left wheels 120 and the right wheels (not shown). Optionally, temperature sensors 116 may be placed at different locations along a length of the vehicle system 102, such as at a front, at a quarter point, at a middle point, at a three-quarter point, and at a back of the vehicle system 102. The monitored temperature data provides an indication of friction between the wheels 120 and the rails 106. For example, increased temperature at the contact interface between the wheels 120 and the rails 106 compared to a temperature at the contact interface at other times or locations along the route may indicate friction due to increased lateral forces and/or friction due to braking operations. Thus, as described below, the temperature information may be analyzed with other information, such as location information of the vehicle system (for example, a global positioning system (GPS)) and brake status information (for example, pressure sensors in air brake line or tank, brake position sensors, or the like) to distinguish between heat due to braking and heat due to lateral forces when traversing a curve in the route.

Figure 2:
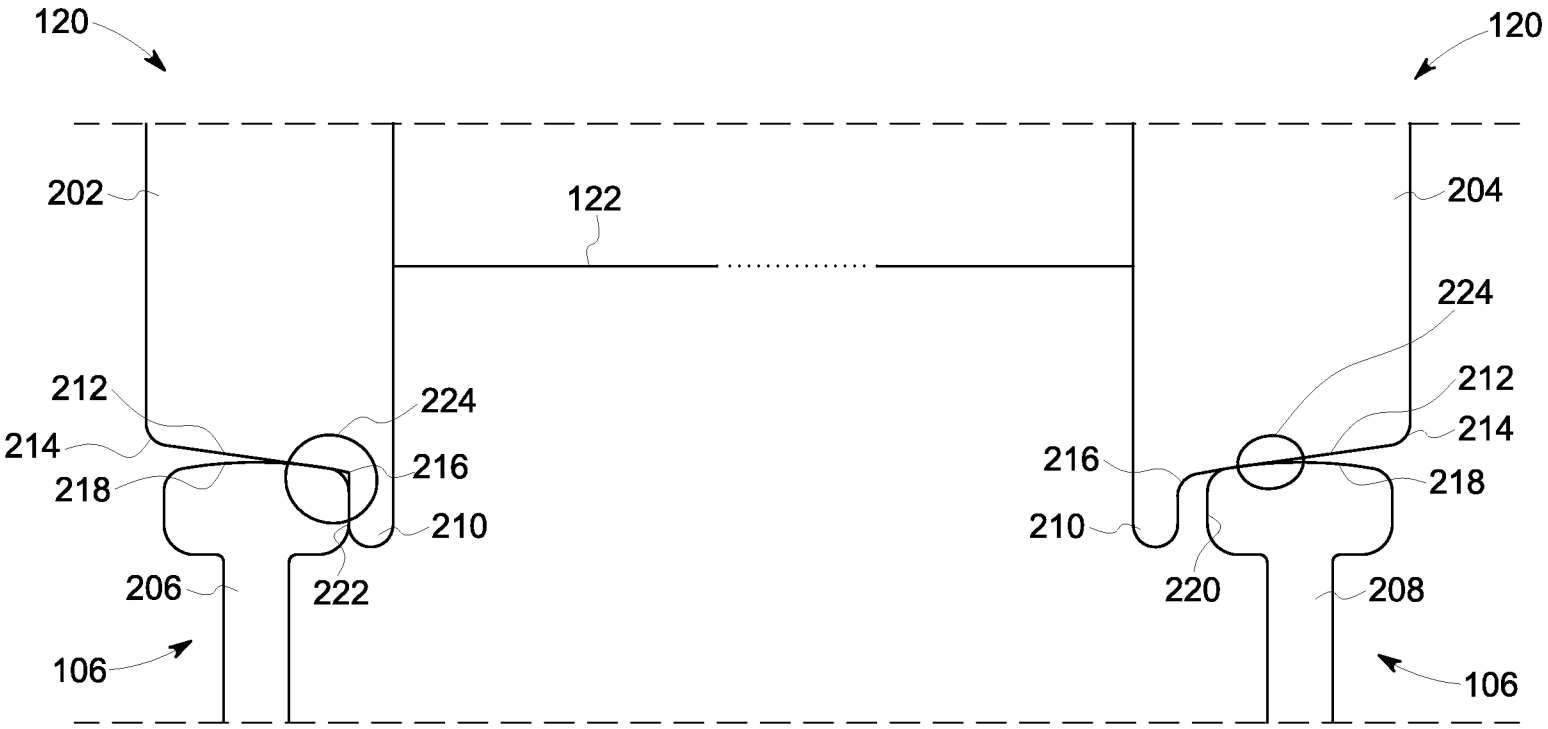
FIG. 2 illustrates wheels of a vehicle system on rails of a track during a flanging event.

FIG. 2 illustrates the wheels 120 of the vehicle system 102 (shown in FIG. 1) on the rails 106 of the track 104 (FIG. 1) during a flanging event. The wheels 120 include a left wheel 202 and a right wheel 204. The rails 106 include a left rail 206 and a right rail 208. The left and right wheels 202, 204 engage the left and right rails 206, 208, respectively. Each of the wheels 120 includes a flange 210 and a running surface 212. The running surface 212 is configured to engage a top 218 of the respective rail 206, 208 as the vehicle system 102 moves. The flange 210 has a greater diameter than the running surface 212 (measured from the axle 122), and is configured to prevent the wheels 120 from falling off of the rails 106. The flange 210 is disposed at an edge of the running surface 212 and is laterally inward of the running surface 212. For example, the flange 210 of the left wheel 202 may be disposed laterally between the running surface 212 of the left wheel 202 and the right wheel 204. Alternatively, the flange 210 may be disposed at an outer edge of the running surface 212. The running surfaces 212 of the wheels 120 may be conical, such that the diameter at an outer side 214 of each running surface 212 is less than the diameter at an inner side 216 of the running surface 212 proximate to the flange 210. Due to the conical-shaped running surface 212, the wheels 120 are configured to be able to move laterally relative to the rails 106 due to inertia, longitudinal forces (e.g., tension and compression), and the like. The flanges 210 provide a hard stop surface that prevents the wheels 120 from moving off of the rails 106. For example, since the wheels 120 are fixed together by the axle 122, as the wheels 120 move laterally to the right, the flange 210 of the right wheel 204 is configured to engage a left side 220 of the right rail 208 to block additional rightward movement of the wheels 120. As the wheels 120 move laterally to the left, the flange 210 of the left wheel 202 is configured to engage a right side 222 of the left rail 206 to block additional leftward movement.

Flanging, or a flanging event, occurs when one of the flanges 210 engages the respective rail 206, 208. During a flanging event, a contact interface 224 between the wheel 202, 204 and the respective rail 206, 208 is has a greater surface area than the contact interface 224 during non-flanging conditions. The contact interface 224 during a flanging event is defined by engagement between the running surface 212 and the top 218 of the respective rail 206, 208 as well as engagement between the flange 210 and the corresponding side 220, 222 of the respective rail 206, 208. Due to the two different areas of contact, significant grinding and friction occurs between the wheel 120 and the respective rail 206, 208. By comparison, during non-flanging conditions the contact interface 224 is defined solely by the engagement between the running surface 212 of the wheel 120 and the top 218 of the respective rail 206, 208. Thus, flanging increases wheel and rail wear more than other orientations between the wheels and the rails during travel. In one or more embodiments, movements of the vehicle system 102 (shown in FIG. 1) are controlled to avoid flanging in order to reduce wear of the wheels 120 and rails 106 and, therefore, decrease maintenance costs.

Flanging also increases the temperature of the wheels 120 and the rails 106 compared to non-flanging conditions due to the grinding and friction at the contact interface 224. By monitoring a temperature profile at the contact interface 224 between the wheels 120 and the rails 106, flanging events may be detected. The temperature profile may be a thermal image that shows temperature gradients along the monitored sections of the wheels 120 and the rails 106. The temperature gradients indicate varying temperature magnitudes relative to area along the monitored sections of the wheels 120 and the rails 106. In the illustrated embodiment, the left wheel 202 is flanging, since the flange 210 is contacting the right side 222 of the rail 206. The flanging may occur as the vehicle system 102 (shown in FIG. 1) is traveling along a curve to the right, such that inertia and longitudinal compressive forces cause the vehicle that includes the wheels 120 to jack-knife. During a jack-knife, the wheels 120 move laterally and radially outward relative to the curve. Since the curve is rightward, the wheels 120 move left until the flange 210 engages the right side 222 of the rail 206, as shown. Alternatively, the illustrated scenario may occur during a left curve in the route in which longitudinal tension pulls the vehicle that includes the wheels 120, causing the vehicle to string-line. During a string-line, the wheels 120 move laterally and radially inward relative to the curve. The vehicle is pulled left and the wheels 120 move laterally left relative to the rails 106 until the flange 210 contacts the right side 222 of the rail 206 to prevent further lateral movement.

In the illustrated embodiment, since the left wheel 202 is flanging and the right wheel 204 is not flanging, the contact interface 224 of the left wheel 202 has a greater surface area than the contact interface 224 of the right wheel 204. In addition, the contact interface 224 of the left wheel 202 is disposed at a different location relative to a lateral center of the left rail 206 than the location of the contact interface 224 of the right wheel 204 relative to a lateral center of the right rail 208. For example, the contact interface 224 of the left wheel 202 extends along the top 218 and the right side 222 of the left rail 206, while the contact interface 224 of the right wheel 204 extends along the only the top 218 of the right rail 208 (e.g., not along the left side 220). Thus, the contact interface 224 of the left wheel 202 is spaced apart from the lateral center of the left rail 206 by a distance that is greater than a distance of the contact interface 224 of the right wheel 204 from the lateral center of the right rail 208.

The contact interfaces 224 are the points of contact, and thus are also the locations that generate the most heat due to friction. The temperature sensors 116 (shown in FIG. 1) are configured to monitor the temperatures profiles of the wheels 120 and rails 106 at the contact interfaces 224, which are used to indicate friction due to flanging and the effect of such friction on wear. Thus, in the illustrated embodiment, the temperature sensors 116 would detect a higher temperature at the contact interface 224 between the left wheel 202 and the left rail 206 than the temperature at the contact interface 224 between the right wheel 204 and the right rail 208 due to the increased friction due to flanging between the left wheel 202 and the left rail 206. In addition, a thermal image would show that the heat between the left wheel 202 and the left rail 206 is generated at or at least proximate to the flange 210 (as shown by the location of the contact interface 224), whereas the heat between the right wheel 204 and the right rail 208 is generated laterally farther away from the flange 210. Thus, a thermal image taken by the temperature sensors 116 would indicate that the left wheel 202 is flanging due to the increased temperature at the contact interface 224, the increased surface area of the contact interface 224, and/or the location of the contact interface 224 relative to a lateral center of the left wheel 202 as compared to the contact interface 224 between the right wheel 204 and the right rail 208.

Referring now back to FIG. 1, the trip planning system 100 further includes a locator device 124 that is configured to determine a location of the vehicle system 102 on a segment of track 104. The locator device 124 may include a GPS receiver or transceiver, an antenna, and associated circuitry. The locator 124 device may be configured to receive global positioning coordinates that indicate a location of the vehicle system 102. The coordinates received from the locator device 124 may be compared to known coordinates of various features along the track, such as locations of curves in the track, to determine a relative proximity of the vehicle system 102 to the curves and other features at different times during a trip. Alternatively, other systems may be used to determine a location of the vehicle system 102, such as radio frequency automatic equipment identification (RF AEI) tags on wayside structures, communications with dispatch, and/or video-based determinations. Another system may use the tachometer(s) aboard a locomotive and distance calculations from a reference point. The vehicle system 102 may further include a wireless communication system 126 that allows wireless communications between vehicle systems and/or with remote locations, such as the remote (dispatch) location 114. Information about travel locations may also be transferred from other vehicle systems over the wireless communication system 126.

The trip planning system 100 includes a track characterization element 128 that provides information about a segment of track, such as grade, elevation, presence of and information about track switches, and curvature information (such as locations of curves, degrees of the curves, and super-elevations of the curves). The track characterization element 128 may also include information about the track 104, including the type of rails 106 (materials and whether heat-treated or not), which affects the wear characteristics of the track 104. The track characterization element 128 may include an on-board track integrity database 130. The on-board track integrity database 130 is configured to store information related to the track 104. The information in the on-board track integrity database 130 may be measured by the vehicle system 102 during an active trip, may have been measured by the vehicle system 102 during previous trips, or may be received by the vehicle system 102 from a remote source, such as the off-board location 114 or a different vehicle system.

The trip planning system 100 also includes a vehicle characterization element 134. The vehicle characterization element 134 provides information about the make-up of the vehicle system 102, such as type of cars 110, number of cars 110, weight of cars 110, whether the cars 110 are consistent (meaning relatively identical in weight and distribution throughout the length of the vehicle system 102) or inconsistent, type of cargo, weight of vehicle system 102, number of locomotives 108, position and arrangement of locomotives 108, type of locomotives 108 (including power output capabilities and fuel usage rates), and the like. The vehicle characterization element 134 may also include information about the wheels 120 of the vehicle system 102, including the materials of the wheels 120 and whether the wheels 120 have been heat-treated or not, which affects the wear of the wheels 120. The vehicle characterization element 134, the track characterization element 128, and/or the on-board track integrity database 130 may be one or more electronic databases stored in a memory storage device on the vehicle system 102. The information in the vehicle characterization element 134, the track characterization element 128, and/or the on-board track integrity database 130 may be input using an input/output (I/O) device by an operator, may be automatically uploaded based on a railroad trip manifest, log, or the like.

The vehicle system 102 includes sensors 132 that measure operating characteristics of the vehicle system 102 during a trip. The operating characteristics may include tractive efforts applied by the locomotive 108, throttle settings of the locomotive 108, speeds of the vehicle system 102, locomotive consist configuration information, individual locomotive configuration information, individual locomotive capabilities, slack and/or longitudinal force measurements between the vehicles of the vehicle system 102, and the like. For example, the sensors 132 may include a speedometer, a vehicle speed sensor (VSS), or the like for measuring speed of the vehicle system 102. The sensors 132 may include throttle and brake position sensors. Optionally, a pressure sensor may be used to detect a pressure of air in an air brake system, such as to determine when braking is occurring.

Furthermore, the vehicle system 102 may include linear force sensors 133 disposed between vehicles (e.g., between the locomotive 108 and the car 110) of the vehicle system 102 that are configured to measure longitudinal forces between the vehicles. For example, the linear force sensors 133 may be string potentiometers (referred to herein as string pots). Alternatively, or in addition, the linear force sensors 133 may include linear variable differential transformers (LVDT), force-sensing resistors, capacitive and inductive sensors, rack-and-pinion transducers, or the like. The coupler 142 between the vehicles 108, 110 is configured to allow the vehicles 108, 110 some relative movement in a longitudinal direction. As the vehicle system 102 moves, longitudinal compressive and tension forces shorten and lengthen the distance between the two vehicles 108, 110 like a spring. The longitudinal forces between the vehicles 108, 110, as measured by the linear force sensor 133, may be used to detect the occurrence of string-lining or jack-knifing, which may cause flanging that increases wheel 120 and rail 106 wear. The longitudinal force measurements may be analyzed, with the temperature profiles of the contact interfaces 224, to corroborate evidence in the temperature profiles that suggests flanging events. For example, a measured longitudinal force over a designated threshold amount of force may suggest string-lining or jack-knifing depending on the direction of the curve and the direction of the longitudinal force (e.g., compression or tension). In response, the movements of the vehicle system 102 may be controlled to keep the longitudinal forces under the threshold amount by traveling at a slower speed along the curves that caused flanging previously when moving at the higher speed. Another way to reduce the longitudinal forces is to increase the number of locomotives 108 in the vehicle system 102 and/or position the locomotives 108 at spaced-apart locations along the length of the vehicle system 102 (instead of stacking the locomotives at the front only, or at the front and rear only).

The trip planning system 100 further includes one or more processors 136 and a controller 138. The one or more processors 136 operate to receive and/or access information from the locator device 124, the track characterizing element 128, the vehicle characterizing element 134, the linear force sensors 133, and the sensors 132. An algorithm operates within the one or more processors 136. The algorithm computes a trip plan based on operating parameters involving the vehicle system 102 and objectives of the trip as described herein. Controlling the movements of the vehicle system along the trip according trip plan computed by the algorithm may be more efficient than controlling the movements of the vehicle system along the trip not according to the trip plan (e.g., without reference to a trip plan or with reference to a different trip plan not computed by the algorithm). In an exemplary embodiment, the trip plan is established based on models for train behavior as the vehicle system 102 moves along the track 104 as a solution of non-linear differential equations derived from applicable physics equations with simplifying assumptions that are provided in the algorithm. The algorithm has access to the information from the locator device 124, the track characterizing element 128 (for example, locations of curves), the vehicle characterizing element 134, the linear force sensors 133, and/or the sensors 132 to create a trip plan that reduces fuel consumption, reduces emissions, reduces wheel and/or track wear, meets a desired trip time, and/or ensures proper crew operating time aboard the locomotive 108 along a trip of the vehicle system relative to controlling the vehicle system along the trip without using the trip plan computed by the algorithm. The controller 138 may control the movement of the vehicle system 102 along the trip, such as to make sure that the vehicle system 102 follows the trip plan. The controller 138 may make operating decisions autonomously or an operator may have discretion to direct the vehicle system 102 to follow or deviate from the trip plan.

According to an embodiment, the temperature profiles at the contact interfaces 224 between the wheels 120 and the rails 106 monitored by the temperature sensors 116 are used to calculate wear rates of the wheels 120 and/or the rails 106.

For example, the monitored temperature profiles during multiple trips along the same route may be correlated with metallic wear rates by measuring wear of the wheels 120 and rails 106 resulting from the multiple trips. For example, the multiple trips may be test runs performed over a single section of a selected track. The selected section may have multiple curves. The same vehicle system 102 may be used to perform each of the test runs. Thus, the wheels 120 and the rails 106 of the track 104 are constant during the test runs. First, the wheels 120 and rails 106 are measured to determine size, diameter, profile of contact surfaces, and the like. The measured information is saved along with characterization information, such as the type of wheels and rails, the materials, whether the wheels and/or rails are heat-treated, and the like, to set a reference wear level for each of the wheels 120 and the rails 106. Furthermore, track characterization information, such as the grade, the location of curves, the degree of curvature of curves, the super-elevation or curves, and the like is recorded and/or uploaded and associated with the test runs. The track characterization information is constant during the first set of test runs. In addition, vehicle characterization information, such as the length of the vehicle system, the weight of the vehicle system, the weight distribution of the vehicle system, the type and number and placement of locomotives, and the like is recorded and/or uploaded and associated with the test runs. Optionally, the vehicle characterization information is constant during the first set of test runs.

During the test runs, the vehicle system 102 operates to travel the selected route, and both the operating characteristics and the temperature of the wheels 120 and rails 106 are monitored. For example, the vehicle system 102 may be controlled according to a first speed profile in which the vehicle system 102 travels through curves at one or more first pre-selected speeds. In order to determine how the operation of the vehicle system 102 affects wear of the wheels 120 and rails 106, the vehicle system 102 may take multiple test runs. For example, the vehicle system 102 may undertake fifty or one hundred test runs using the same wheels 120 and over the same rails 106 before the wheels 120 and rails 106 are measured for wear. In order to determine the wear, the diameters, size, profiles, and/or mass of the wheels 120 and/or rails 106 are measured to determine a first wear state. For example, various mechanical and/or digital gauges, scales, laser sensors, or the like, may be used to measure the characteristics of the wheels 120 and rails 106 at each wear state. The measurements of the first wear state are compared to the same measurements from the reference wear level to determine a change due to wear, or an amount of wear caused by the test runs. For example, the slightly convex top surface 218 (shown in FIG. 2) of the rails 106 may have a flatter (or more planar) profile due to wear. The amount and locations of wear may be compared to the monitored temperature profiles of the wheels 120 and rails 106 during the test runs to provide an initial correlation between temperature and wear.

In an embodiment, one or more additional sets of test runs may be performed over the same section of track 104 using the same vehicle system 102. Variables that may be changed for subsequent sets of test runs include operating characteristics, such as speed profiles, and vehicle characteristics, such as length and weight of the vehicle system and arrangement of locomotives 108 relative to cars 110. For example, a second test set may only alter the speed profile, while keeping other variables constant, to determine the effect of changing the speed of the vehicle system 102 on the wear rate. The first wear state of the wheels 120 and rails 106 may be considered a new reference wear level, such that a second wear state of the wheels 120 and rails 106 measured after the second set of test runs may be compared to the new reference wear level to determine the change in wear due to the second set of test runs. The second speed profile may be more aggressive than the first speed profile, such that the vehicle system 102 traverses the curves at a higher speed than during the first set of test runs. In another set of test runs, the vehicle characteristics may be altered by changing the arrangement of locomotives 108. For example, some test runs may be performed where the vehicle system 102 only includes locomotives 108 at the front and/or the back of the vehicle system 102, and other test runs may be performed where at least one locomotive 108 is disposed within a middle segment of the vehicle system 102. Placing one or more locomotives 108 within a middle segment may reduce longitudinal forces that cause string-lining and jack-knifing along curves.

The data relating to the track characteristics, vehicle characteristics, operating characteristics (for example, speed profiles), temperature information (at the contact interfaces 224 between the wheels 120 and the rails 106), and/or wear information (for example, amount of wear and wear rates) may be recorded for each of the sets of test runs in a physics database 140. The physics database 140 may be disposed on the vehicle system 102, such as in or coupled to the one or more processors 136. Alternatively, the data may be transmitted by the communication system 126 to a remote storage or processing location, such as the off-board location 114.

After changing the variables of operating characteristics and vehicle characteristics and recording the information in the physics database 140, other test runs may be performed by changing the track characteristics, such as by performing test runs over other sections of the same route or different routes. For example, a new section of route may include different grades, different speed restrictions, different curve characteristics, and the like. Thus, various test runs may be performed by changing variables such as track characteristics, vehicle characteristics, and operating characteristics, and monitoring the effects of such changes on temperature and wear between the wheels 120 and the rails 106. The information is recorded in the physics database 140. The physics database 140 allows for analysis of large amounts of the data to determine correlations. Such correlations are used by the trip planning system 100 to plan trips that increase some parameters, such as speed, while reducing other parameters, such as fuel usage and wheel 120 and rail 106 wear.

In addition to, or as an alternative to, storing information from test runs in the physics database 140, the physics database 140 may include experimental data from lab tests. For example, wear dynamics of various types and sizes of wheels and rails may be studied in a lab to re-create conditions experienced in the field. As an example, a wheel (or a portion of metal simulating a wheel) may be rotated on a section of rail with various forces applied between the wheel and the rail. The lab environment may be able to simulate the forces experienced during a flanging event. Dynamometers or other devices may be used to measure the torque and other forces involved. Temperature sensors monitor the heating generated at the contact surface(s). The amount of wear may be determined by digital (for example, laser) or mechanical gauges, by measuring a mass and composition of captured metallic dust discharged from the wheels 120 and/or rails 106, or the like, combined with known metallurgy and/or tribology information. The temperature profiles recorded by the temperature sensors may be analyzed with the amount of wear to determine the correlation between the temperature at the contact interfaces 224 and the wear rates of the wheels 120 and/or rails 106. Optionally, the physics database 140 may include both lab data and recorded data from test runs.

As an alternative to measuring the wear on the wheels 120 and rails 106 directly, the monitored temperature information may be used to determine the amount of wear based on the known tribology of the wheels 120 and rails 106. For example, by monitoring the temperature, the slack action between vehicles (using string pots), brake pipe pressure (to determine when recorded heat is due in part to friction from braking), and tachometer measurements of the tractive motors (not shown) of the locomotive 108, the wear may be calculated. The calculated wear may also be compared to the measured wear in order to determine a level of accuracy or precision of the calculation.

Referring to FIG. 2 again, the temperature profiles at the contact interfaces 224, alone or in combination with measured longitudinal forces, can be used to detect flanging events as the vehicle system 102 (shown in FIG. 1) travels through a curve in the track 104 (FIG. 1) along the route. For example, if the curve is to the left, and the measured longitudinal forces indicate high longitudinal stretch or tension through the curve, then that information suggests that the left wheel 202 may be flanging due to string-lining, which corroborates any evidence in the temperature profile that the left wheel 202 is flanging. Such evidence may include that the contact interface 224 at the left wheel 202 is hotter, has a broader surface area, and/or is farther from a lateral center of the respective rail 106, than the contact interface 224 at the right wheel 204.

Once the physics database 140 is developed, the physics database 140 may be used when planning future trips in order to control in-train forces using the trip planning system 100 to reduce wear and fuel use, such as by avoiding flanging events around curves. Reduced fuel usage may be an inherent benefit of reducing flanging because less friction between the wheels 120 and the rails 106 reduces the amount of fuel needed to achieve a desired speed.

The physics database 140 is used to show the correlation between operating characteristics of certain vehicle systems on certain routes and resulting wheel 120 and rail 106 wear. In an embodiment, the physics database 140 may be combined with financial information of a railroad company in order to determine how the operating characteristics affect the railroad company's profits. For example, a railroad company may increase operating gains or income by making timely or successful trips (for example, arriving at a destination location at or prior to a scheduled delivery time) and increasing average system velocity and throughput (for example, running multiple vehicle systems efficiently through a network of routes to increase the number of successful trips overall). A railroad company also has to consider operating costs, such as the price of fuel and the effects of emissions (such as penalties and fines for exceeding acceptable emissions thresholds). Trip plans may be generated to increase speed and reduce fuel usage and emissions to increase the amount of profit for the trip secured by the railroad company. Operating costs also include the cost of maintenance, however, which includes expensive repair costs for replacing worn wheels 120 and rails 106 and the cost of down-time delays during maintenance operations. These operating costs for maintenance are not generally taken into account when planning a trip, but the expense of such maintenance may be significant.

The physics database 140 may be combined with financial information about the costs of maintenance, including wheel 120 replacement, track 104 replacement (including replacing one or both conductive rails 106), and repairs to determine a correlation between the operations of vehicle systems along a route and the resulting maintenance costs that accrue. Based on the correlation, the trip planning system 100 may factor in the costs of maintenance due to wheel 120 and track 104 wear when planning a trip. For example, by operating a first vehicle system along a trip at an aggressive speed profile, the first vehicle system will arrive at the destination earlier than a second vehicle system operating according to a less aggressive speed profile. The first vehicle system may earn more monetary gain for the railroad due to a higher delivery profit or bonus and an overall increased throughput along the network of routes. However, the more aggressive speed profile causes more wheel 120 and track 104 wear, such as around curves in the track 104. Assuming the same first and second vehicle systems travel on the same routes according to the same speed profiles as described above for many trips over multiple years, the track traversed by the first vehicle system may need to be replaced years sooner than the track traversed by the second vehicle system as a result of the wear caused by the first vehicle system. Thus, over a given number of years, the first vehicle system may generate $200,000 more gain than the second vehicle system (due to achieving more bonuses and increased throughput along the network) by traveling more aggressively, but the track traversed by the first vehicle system and/or the wheels of the first vehicle system may require $250,000 more in repair costs due to wear than the track and/or wheels of the second vehicle system. As a result, the second vehicle system has a greater operating profit by $50,000 than the first vehicle system over the designated time period, even though the second vehicle system is operated less aggressively.

By combining the physics database 140 with the financial information, the amount of wear for a given operational characteristics of a given vehicle system along a given route may be converted into a monetary value or equation. The trip planning system 100 may be configured to perform trade-offs between the maintenance costs and the operating gains when determining a speed profile for a trip plan in order to increase operating profit.

As mentioned above, the vehicle system 102 may include multiple locomotives 108 that operate using distributed power, where one locomotive is a lead locomotive and sends operating command to the remote locomotives. Distributed power may be used to reduce longitudinal forces in the vehicle system 102, which reduces wear (and maintenance costs due to wear). For example, if a vehicle system only includes one or more locomotives at the front, then as a group of cars of the vehicle system are pulled along a curve, the longitudinal tension may cause the cars to string-line, which increases wear and fuel usage (due to increased friction). But, in an embodiment with at least one locomotive in front of the group of car and also at least one locomotive behind the group of cars, the cars may be pulled and pushed along the curve, such that the amount of pull is less than with only a front locomotive. Therefore, the cars are less likely to string-line. In addition, distributed power provides additional flexibility. For example, a front group of cars may be lighter than a rear group of cars due to the front and rear groups carrying different cargo. The front group may require less force or tractive effort from the locomotives around a curve than the rear group due to the difference in weight. By including multiple locomotives at different locations along the vehicle system that operate according to distributed power, a rear locomotive proximate to the rear group of cars may be configured to provide more tractive effort than a front locomotive proximate to the front group of cars as the groups of cars travel along each curve.

Figure 3:
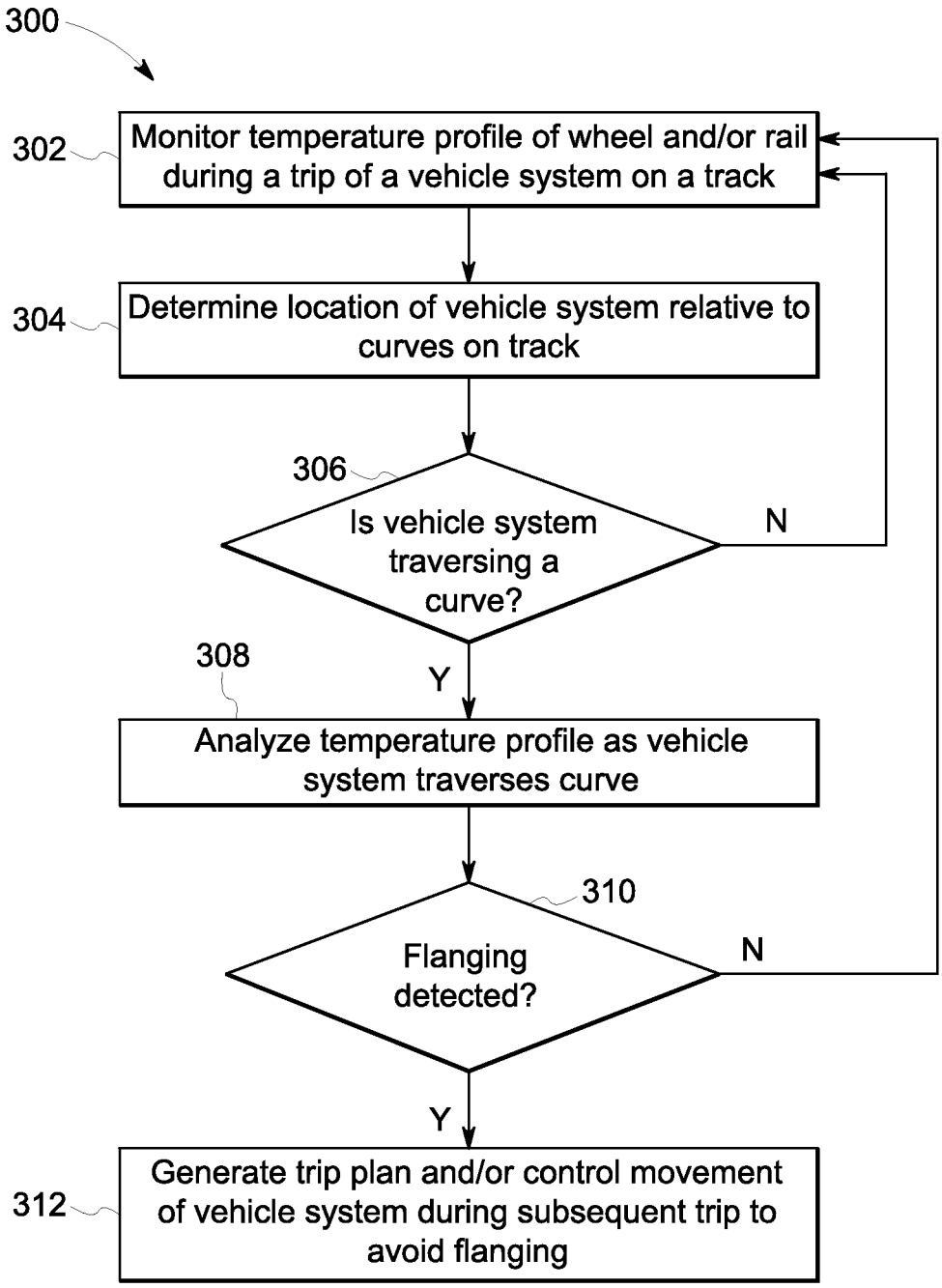
FIG. 3 is a flow chart for a method of determining an amount of wear of a wheel of a vehicle system and/or a rail of a track along a curve on the track.

FIG. 3 is a flow chart for a method 300 of determining an amount of wear of a wheel of a vehicle system and/or a rail of a track along a curve on the track. At 302, a temperature profile of the wheel and/or the rail is monitored during a trip of the vehicle system on the track. The temperature profile may be monitored by a temperature sensor. The temperature profile is configured to measure and record temperatures at the contact interface between the wheel and the rail as the vehicle system travels on the track. At 304, a location of the vehicle system is determined relative to curves on the track. The location relative to curves may be determined using a locator device, such as a global positioning system (GPS) device, in combination with track characterization information. For example, the locator device provides a geographic location of the vehicle system, and the track characterization information provides a geographic location information of curves along the track. The geographic locations of the vehicle system and the curves are compared to determine relative proximity. The geographic locations of the vehicle system and the curves in the track may be compared by the one or more processors 136 (shown in FIG. 1) on the vehicle system 102 (FIG. 1). At 306, a determination is made whether the vehicle system is traversing a curve. For example, the determination depends on the relative proximity of the vehicle system to known curves of the track. If the geographic location of the vehicle system matches the geographic location of one of the curves, then the vehicle system is traversing a curve, and the flow of the method 300 continues to step 308. If, however, the vehicle system is not traversing a curve, then the flow of the method 300 ends or returns to step 302 to monitor the temperature profile at the contact interface.

At 308, the temperature profile at the contact interface between the wheel and the rail is analyzed for the period that the vehicle system traverses a curve in the track. Various characteristics of the contact interface may be determined by analyzing the temperature profile, such as a maximum temperature of the contact interface, a surface area of the contact interface, and/or a location of the contact area relative to a reference point, such as a lateral center of the rail. At 310, a determination is made whether flanging is detected. Flanging occurs when a flange of the wheel engages and grinds against a side of the corresponding rail that the wheel engages. Since visual observation of the contact interface during the trip is difficult, flanging may be detected based on the temperature profile indicating that the flange of the wheel engages the side of the rail. For example, the temperature profile may provide various characteristics of the contact interface, which may be compared to corresponding designated thresholds to determine if the measured characteristics of the contact interface exceed the corresponding designated thresholds, indicating a flanging event. The designated thresholds may be determined based on experimental calculations and/or measured values collected during various previous trips of the same vehicle system or other vehicle systems.

One characteristic of the contact interface is a temperature, and flanging may be detected responsive to the temperature of the contact interface exceeding a designated temperature threshold. The designated temperature threshold may be a set value in degrees Celsius or Fahrenheit, or, alternatively, may be a temperature gradient, such as a temperature difference (e.g., 5 degrees, 10 degrees, or the like) between the maximum temperature recorded by the temperature sensor and the minimum temperature recorded by the temperature sensor at a single moment of data collection. For example, since flanging results in significant friction between the wheel and the rail, the increased friction produces more heat than during non-flanging conditions. The heat increases the temperature of the contact interface, and the temperature increase is monitored by the temperature sensor as shown in the temperature profile. The designated temperature threshold may be a recognized low temperature or temperature increase of the wheel and/or rail that occurs when the flange of the wheel engages the side of the rail, such that monitored temperature profiles having temperatures and/or temperature increases higher than the designated temperature indicate that the wheel is flanging on the rail.

Another characteristic of the contact interface is a surface area, and flanging may be detected responsive to the surface area of the contact interface exceeding a designated area threshold. For example, the temperature profile indicates a surface area of the contact interface based on the size of an increased temperature region as shown on a thermal image, where the increased temperature region represents an increased temperature attributable to friction between the wheel and the rail. The designated area threshold may be 100 $mm^2$, 200 $mm^2$, or the like. During a flanging event, both the running surface and the flange engage respective top and side surfaces of the rail, producing heat from friction along both interface locations. Thus, the temperature profile indicates increased temperature along both interface locations instead of primarily only along the one interface location between the running surface of the wheel and the top of the rail.

Still yet another characteristic of the contact interface is a location of the contact interface relative to the wheel and/or the rail. The flanging event may be detected responsive to the location of the contact interface exceeding a designated distance threshold relative to a reference point, such as a lateral center of the wheel and/or the rail. For example, the flange is disposed at an outer edge of the wheel, so when the flange engages the side of the rail during a flanging event, the contact interface is spaced apart (or at least extends) laterally relative to a lateral center of the wheel and/or the rail. The distance between the contact interface and the reference point may be measured from a nearest edge of the contact interface to the reference point or a calculated midpoint of the contact interface. The designated distance threshold may be 3 mm, 5 mm, 10 mm, or the like.

In an embodiment, operating characteristics of the vehicle system may also be monitored, including tractive forces, braking forces, and longitudinal (in-vehicle system) forces. The tractive forces may be monitored by measuring throttle position, generated horsepower, revolutions per minute (RPMs), or the like. The braking forces may be monitored by measuring brake line pressure, brake position, or the like. The longitudinal forces between vehicles in the vehicle system may be measured using string pots, position sensors, or the like. Temperature increases in the temperature profile that are due to friction generated by braking forces are distinguished from temperature increases that are due to lateral forces between the wheel and the rail along the curve. For example, if it is determined that the vehicle system is braking during a given time interval as the vehicle system traverses a curve, then the temperature increase shown in the temperature profile is identified as being due to the braking forces. Such temperature increase may be disregarded since it may be difficult to determine what fraction of the temperature increase is due to braking and what fraction is due to lateral forces that could indicate flanging. But, if it is determined that the vehicle system is not braking during the time interval along a curve, then the temperature increase during that time interval is identified as being due to friction between the wheel and the rail due to lateral forces.

If flanging is not detected, flow of the method 300 ends or returns to step 302. If, on the other hand, flanging is detected, flow of the method 300 continues to 312. Since flanging increases wheel and rail wear, information about the conditions of the trip that resulted in the flanging event may be used to avoid flanging during subsequent trips. At 312, a trip plan is generated and/or the movement of the vehicle system during a subsequent trip is controlled to avoid flanging as the vehicle system traverses the curve in the track. For example, if the vehicle system was controlled according to a first speed profile along the route and flanging was detected as the vehicle system traversed a respective curve in the track at a first speed, then the vehicle system may be controlled during a subsequent second trip along the same route according to a second speed profile that controls the vehicle system through the curve at a second speed that is slower than the first speed to avoid or at least reduce the likelihood of flanging along the curve.

Optionally, the temperature profile, information regarding the amount of wear of the wheel and/or the rail, track characterization information, vehicle system characterization information, and/or operating characterization information may be stored in a physics database. Thus, the amount of wear may be stored with information that describes the characteristics of the track (including curve location, curve super-elevation, radius of curve, direction of curve, material of rails and whether rails are heat-treated, etc.), the characteristics of the vehicle system (including length of vehicle system, weight of vehicle system, type, number, and location of locomotives, type of cars, cargo in cars, material of wheels and whether wheels are heat-treated, etc.), and the characteristics of the operations of the vehicle system (including speed around curves, whether distributed power is used, horsepower around curves, fuel usage, emissions, time to complete trip, arrival time at destination, etc.). The physics database may be used to provide correlations among this information to allow for predicted wear rates based on vehicle systems having different vehicle system characteristics, tracks having different track characteristics, and trips having different operating characteristics of the vehicle system on the tracks.

Figure 4:
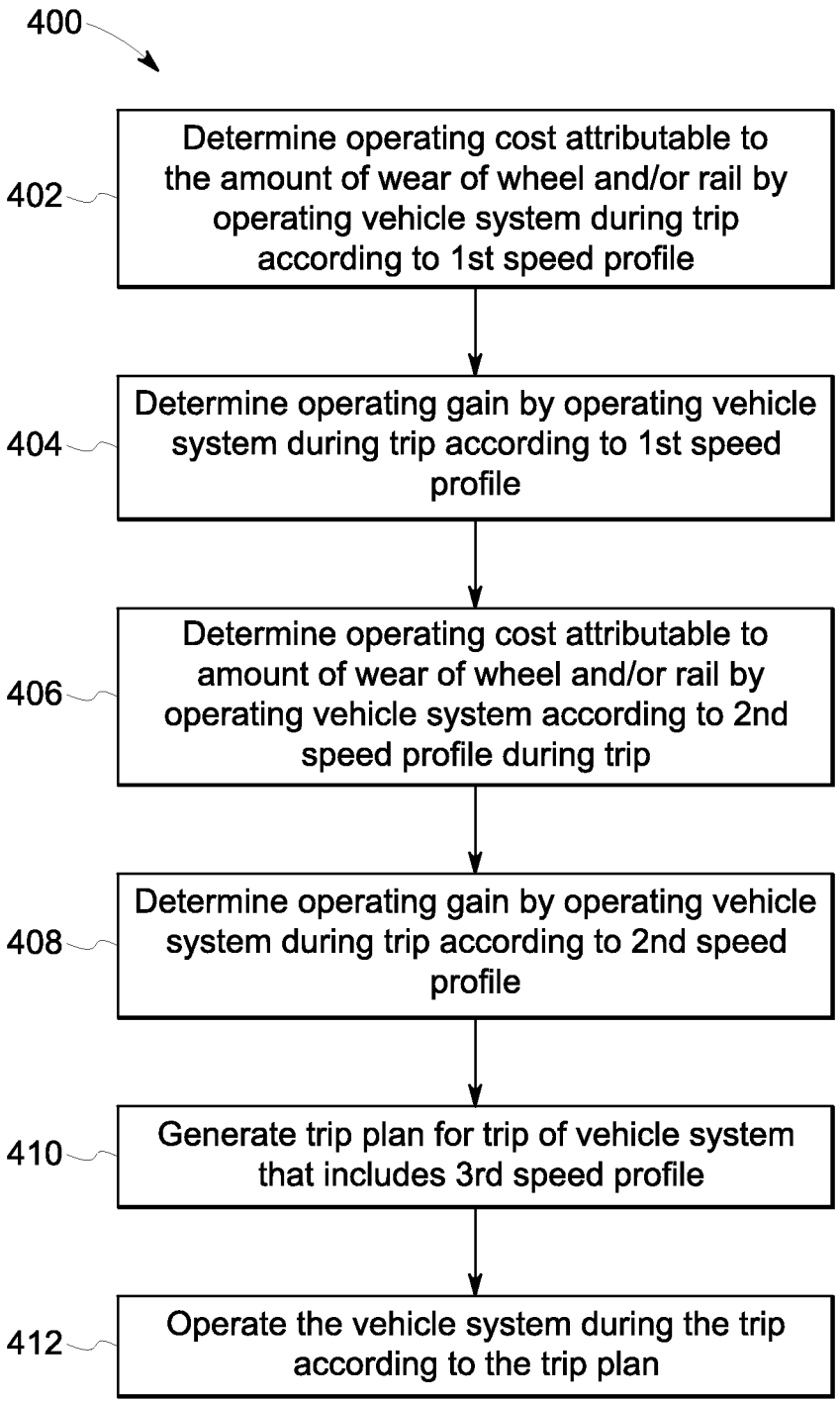
FIG. 4 is a flow chart for a method of operating a vehicle system on a trip to increase operating profit of the trip.

FIG. 4 is a flow chart for a method 400 of operating a vehicle system on a trip to increase operating profit of the trip. At 402 an operating cost attributable to the amount of wear of a wheel of a vehicle system and/or a rail of a track by operating the vehicle system during a trip on the track according to a first speed profile is determined. The speed profile includes speeds of the vehicle system along the trip, including speeds of the vehicle system along curves in the track. The amount of wear may be determined based on an actual trip of the vehicle system, such as described in the method 300 (shown in FIG. 3), or may be based on a projected trip of the vehicle system using the compiled physics database (described in step 314 of method 300). The operating cost attributable to the amount of wear may be determined by combining financial information with the amount of wear for the speed profile. For example, running a trip at the first speed profile may degrade a wheel by 0.1% of the life of the wheel (such that the wheel would need to be repaired and/or replaced after one thousand such trips of the vehicle system at the first speed profile). The financial information includes costs of repairing and/or replacing the wheel and/or the rail. Thus, the cost of running the trip by the vehicle system at the first speed profile may be one thousandth the cost of repairing and/or replacing the wheel (or 0.001X, where X is the cost of repairing and/or replacing the wheel). The operating cost also includes the cost of fuel for propelling the vehicle system along the route. At 404, the operating gain by operating the vehicle system during the trip according to the first speed profile is determined. The operating gain may be determined by combining financial information with the trip for the first speed profile. For example, a more aggressive speed profile may include faster speeds around curves, which results in shorter overall travel time and earlier arrival at a destination than a less aggressive speed profile. The operating gain may include a delivery bonus or profit for arriving at the destination by or before a scheduled delivery time. The delivery bonus is a quantifiable value. Furthermore, the more aggressive speed profile may avoid an operating cost or penalty for arriving late to the destination. The operating gain also may include an overall increase in throughput in a network of routes by running the vehicle system more aggressively, resulting in fewer delays for other vehicle systems on the network.

At 406, the operating cost attributable to the amount of wear of the wheel and/or the rail by operating the vehicle system during the trip according to a second speed profile is determined. The second speed profile may be more aggressive or less aggressive than the first speed profile. The vehicle system and the trip, including the track, are the same as the vehicle system and the trip in steps 402 and 404. For example, the second speed profile may be less aggressive than the first speed profile (at least along the curves) such that running the trip at the second speed profile may degrade the wheel and/or the rail by 0.05% of the life of the wheel. The operating cost of running the trip according to the second speed profile is five ten-thousandths the cost of repairing and/or replacing the wheel (or 0.0005X), which is half of the operating cost of running the trip according to the first speed profile (0.001X). The cost of fuel according to the second speed profile also may be less than running the vehicle system according to the more aggressive first speed profile. At 408, the operating gain by operating the vehicle system during the trip according to the second speed profile is determined. Assuming the second speed profile is less aggressive than the first speed profile, the operating gain may be lower for the second speed profile due to a later arrival time at the destination, a longer trip time, and a reduced throughput along the network of routes. Thus, the less aggressive speed profile may result in a lower operating gain as well as lower operating costs.

At 410, a trip plan for the trip of the vehicle system according to a third speed profile is generated. The trip plan is generated based on the operating costs and the operating gains attributable to controlling the movement of the vehicle system along the route at the first and second speed profiles. The trip plan is configured to increase operating profit, which is the operating gain minus the operating costs. The trip plan may be generated by comparing a projected (or actual) operating profit of running the vehicle system on the trip according to the first speed profile to a projected (or actual) operating profit of running the vehicle system on the trip according to the second speed profile. If the first speed profile results in a higher operating profit than the second speed profile, the third speed profile may be more similar to the first speed profile than the second speed profile. The third speed profile may be a level of aggressiveness that is between the first and second speed profiles or outside of the first and second speed profiles. Optionally, the third speed profile may be the first speed profile or the second speed profile, depending on which of the first and second speed profiles results in a higher operating profit. At 412, the vehicle system is operated during the trip according to the generated trip plan. For example, the tractive and braking efforts of the vehicle system along the tracks of the trip may be controlled according to the trip plan so the vehicle system travels at the third speed profile.

In an embodiment, a method includes determining a location of a vehicle system traveling on a track during a first trip relative to a curve in the track. The method also includes monitoring a temperature profile at a contact interface between a wheel of the vehicle system and a conductive rail of the track that contacts the wheel as the vehicle system traverses the curve in the track. The temperature profile is based, at least in part, on a first speed profile of the vehicle system during the first trip. The method further includes analyzing the temperature profile to detect a flanging event between the wheel and the rail as the vehicle system traverses along the curve in response to the temperature profile indicating that a flange of the wheel engages a side of the rail.

In an aspect, the temperature profile indicates that the flange of the wheel engages the side of the rail responsive to a characteristic of the contact interface exceeding a threshold. In an aspect, the characteristic of the contact interface is a temperature at the contact interface and the threshold is a designated temperature. In another aspect, the characteristic of the contact interface is a surface area of the contact interface and the threshold is a designated area. In another aspect, the characteristic of the contact interface is a location of the contact interface relative to at least one of the wheel or the rail. The threshold is a designated distance relative to a lateral center of the at least one of the wheel or the rail.

In an aspect, the method further comprises controlling movement of the vehicle system on the track according to a second speed profile during a subsequent second trip to avoid the flanging event as the vehicle system traverses the curve in the track. In response to detecting the flanging event as the vehicle system traverses the curve according to the first speed profile during the first trip, the movement of the vehicle system is controlled during the subsequent second trip according to the second speed profile that is less aggressive around the curve relative to the first speed profile.

In an aspect, the method further comprises disregarding temperature increases in the temperature profile responsive to detecting braking efforts of the vehicle system as the vehicle system traverses the curve.

In an aspect, the method further comprises generating a trip plan for a subsequent second trip of the vehicle system on the track. The trip plan designates at least one of tractive efforts or braking efforts for the vehicle system such that the vehicle system traverses the curve in the track at a speed that avoids the flanging event.

In an aspect, the location of the vehicle system relative to the curve in the track is determined by comparing global positioning coordinates of the vehicle system received by a locator device on the vehicle system to global positioning coordinates of the curve in the track that are stored in a database on the vehicle system.

In an aspect, the method further comprises measuring an amount and direction of longitudinal force between two vehicles in the vehicle system as the vehicle system traverses the curve. The wheel is a component of one of the two vehicles. The method further includes determining whether the wheel is pulled radially inward relative to the curve or pushed radially outward relative to the curve as the vehicle system traverses the curve based on the longitudinal force.

In an embodiment, system includes a locator device, a temperature sensor, and one or more processors. The locator device is configured to determine a location of a vehicle system traveling on a track during a first trip. The temperature sensor is configured to monitor a temperature profile at a contact interface between a wheel of the vehicle system and a conductive rail of the track that contacts the wheel as the vehicle system traverses the track. The one or more processors are configured to identify when the vehicle traverses a curve in the track based on the location of the vehicle system. The temperature profile at the contact interface as the vehicle system traverses the curve is based, at least in part, on a first speed of the vehicle system along the curve. The one or more processors are further configured to analyze the temperature profile to detect a flanging event between the wheel and the rail as the vehicle system traverses along the curve in response to a characteristic of the contact interface exceeding a threshold.

In an aspect, the wheel has a conically-shaped running surface and a flange at an edge of the running surface. The wheel is configured to move laterally relative to the rail as the vehicle system travels on the track. The one or more processors are configured to detect the flanging event responsive to the temperature profile indicating that the flange of the wheel engages a side of the rail.

In an aspect, the characteristic of the contact interface is a temperature at the contact interface and the threshold is a designated temperature.

In an aspect, the characteristic of the contact interface is a surface area of the contact interface and the threshold is a designated surface area.

In an aspect, the characteristic of the contact interface is a location of the contact interface relative to at least one of the wheel or the rail. The threshold is a designated distance relative to a lateral center of the at least one of the wheel or the rail.

In an aspect, the system further comprises a linear force sensor disposed between two vehicles of the vehicle system. The wheel is a component of one of the two vehicles. The linear force sensor is configured to measure an amount and direction of longitudinal force between the two vehicles. The one or more processors are configured to determine whether the wheel is pulled radially inward relative to the curve or pushed radially outward relative to the curve as the vehicle system traverses the curve based on the longitudinal force measured between the two vehicles.

In an aspect, in response to detecting the flanging event as the vehicle system traverses the curve at the first speed during the first trip, the one or more processors are configured to control movement of the vehicle system during a subsequent second trip on the track such that the vehicle system traverses the curve at a second speed that is slower than the first speed to avoid the flanging event.

In an aspect, the one or more processors are further configured to generate a trip plan for a subsequent second trip of the vehicle system on the track. The trip plan designates at least one of tractive efforts or braking efforts for the vehicle system such that the vehicle system traverses the curve in the track during the second trip at a second speed that differs from the first speed.

In an aspect, the locator device is configured to receive global positioning coordinates of the vehicle system. The one or more processors are configured to compare the global positioning coordinates of the vehicle system to global positioning coordinates of the curve in the track that are stored in a database on the vehicle system to calculate a proximity of the vehicle system relative to the curve in the track.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc. are used merely as labels, and are not intended to impose numerical requirements on their objects. Further, the limitations of the following clauses are not written in means-plus-function format and are not intended to be interpreted based on 35 U.S.C. §112(f), unless and until such clause limitations expressly use the phrase "means for" followed by a statement of function void of further structure.

What is claimed is:

1. A method comprising:

determining a location of a vehicle system traveling on a track during a first trip relative to a curve in the track;

monitoring a temperature profile at a contact interface between a wheel of the vehicle system and a rail of the track that contacts the wheel as the vehicle system traverses the curve according to a first speed profile of the vehicle system;

analyzing the temperature profile to detect a flanging event between the wheel and the rail as the vehicle system traverses along the curve in response to the temperature profile indicating that a flange of the wheel engages a side of the rail, and with a processor, at least one of controlling the vehicle system or directing an operator to control the vehicle system responsive to the flanging event that is detected.

2. The method of claim 1, wherein the temperature profile indicates that the flange of the wheel engages the side of the rail responsive to a characteristic of the contact interface exceeding a threshold.

3. The method of claim 2, wherein the characteristic of the contact interface is a temperature at the contact interface and the threshold is a designated temperature.

4. The method of claim 2, wherein the characteristic of the contact interface is a surface area of the contact interface and the threshold is a designated area.

5. The method of claim 2, wherein the characteristic of the contact interface is a location of the contact interface relative to at least one of the wheel or the rail, and the threshold is a designated distance relative to a lateral center of the at least one of the wheel or the rail.

6. The method of claim 1, further comprising controlling movement of the vehicle system on the track according to a second speed profile during a subsequent second trip to avoid the flanging event as the vehicle system traverses the curve in the track.

7. The method of claim 6, wherein in response to detecting the flanging event as the vehicle system traverses the curve according to the first speed profile during the first trip, the movement of the vehicle system is controlled during the subsequent second trip according to the second speed profile that is less aggressive around the curve relative to the first speed profile.

8. The method of claim 1, further comprising disregarding temperature increases in the temperature profile responsive to detecting braking efforts of the vehicle system as the vehicle system traverses the curve.

9. The method of claim 1, further comprising generating a trip plan for a subsequent second trip of the vehicle system on the track, the trip plan designating at least one of tractive efforts or braking efforts for the vehicle system such that the vehicle system traverses the curve in the track during the subsequent second trip at a speed that avoids the flanging event.

10. The method of claim 1, wherein the location of the vehicle system relative to the curve in the track is determined by comparing global positioning coordinates of the vehicle system received by a locator device on the vehicle system to global positioning coordinates of the curve in the track that are stored in a database on the vehicle system.

11. The method of claim 1, further comprising measuring an amount and direction of longitudinal force between two vehicles in the vehicle system as the vehicle system traverses the curve, the wheel being a component of one of the two vehicles, and determining whether the wheel is pulled radially inward relative to the curve or pushed radially outward relative to the curve as the vehicle system traverses the curve based on the longitudinal force.

12. A system comprising:

a locator device configured to determine a location of a vehicle system traveling on a track during a first trip;

a temperature sensor configured to monitor a temperature profile at a contact interface between a wheel of the vehicle system and a rail of the track that contacts the wheel as the vehicle system traverses the track; and one or more processors configured to identify when the vehicle traverses a curve in the track based on the location of the vehicle system, the one or more processors further configured to analyze the temperature profile to detect a flanging event between the wheel and the rail as the vehicle system traverses the curve at a first speed of the vehicle system in response to the temperature profile indicating that a flange of the wheel engages a side of the rail.

13. The system of claim 12, wherein the wheel has a conically-shaped running surface, the flange extending radially outward from an edge of the running surface, the wheel being configured to move laterally relative to the rail as the vehicle system travels on the track, the one or more processors configured to detect the flanging event responsive to the temperature profile indicating that both the flange and the running surface of the wheel engage the rail.

14. The system of claim 12, wherein the one or more processors are configured to analyze the temperature profile to detect the flanging event responsive to a temperature at the contact interface exceeding a designated threshold temperature.

15. The system of claim 12, wherein the one or more processors are configured to analyze the temperature profile to detect the flanging event responsive to a surface area of the contact interface exceeding a designated threshold surface area.

16. The system of claim 12, wherein the one or more processors are configured to analyze the temperature profile to detect the flanging event responsive to a location of the contact interface relative to at least one of the wheel or the rail exceeding a designated threshold distance relative to a lateral center of the at least one of the wheel or the rail.

17. The system of claim 12, further comprising a linear force sensor disposed between two vehicles of the vehicle system, the wheel being a component of one of the two vehicles, the linear force sensor configured to measure an amount and direction of longitudinal force between the two vehicles, the one or more processors configured to determine whether the wheel is pulled radially inward relative to the curve or pushed radially outward relative to the curve as the vehicle system traverses the curve based on the longitudinal force measured between the two vehicles.

18. The system of claim 12, wherein in response to detecting the flanging event as the vehicle system traverses the curve at the first speed during the first trip, the one or more processors are configured to control movement of the vehicle system during a subsequent second trip on the track such that the vehicle system traverses the curve at a different, second speed to avoid the flanging event.

19. The system of claim 12, wherein the one or more processors are further configured to generate a trip plan for a subsequent second trip of the vehicle system on the track, the trip plan designating at least one of tractive efforts or braking efforts for the vehicle system such that the vehicle system traverses the curve in the track during the second trip at a second speed that differs from the first speed.

20. The system of claim 12, wherein the locator device is configured to receive global positioning coordinates of the vehicle system, the one or more processors being configured to compare the global positioning coordinates of the vehicle system to global positioning coordinates of the curve in the track that are stored in a database on the vehicle system to calculate a proximity of the vehicle system relative to the curve in the track.

* * * * *